US007500870B2

(12) United States Patent
Picolli

(10) Patent No.: US 7,500,870 B2
(45) Date of Patent: Mar. 10, 2009

(54) ELECTRONIC DEVICE MOUNTING APPARATUS

(76) Inventor: Richard Picolli, 71 Ridge Rd., Rutherford, NJ (US) 07070

( * ) Notice: Subject to any disclaimer, the term of this patent is extended or adjusted under 35 U.S.C. 154(b) by 309 days.

(21) Appl. No.: 11/584,935

(22) Filed: Oct. 23, 2006

(65) Prior Publication Data

US 2008/0117610 A1 May 22, 2008

(51) Int. Cl.
*H01R 13/60* (2006.01)

(52) U.S. Cl. ..... 439/535; 348/143; 307/140

(58) Field of Classification Search ..... 439/535; 348/143; 307/140
See application file for complete search history.

(56) References Cited

U.S. PATENT DOCUMENTS

| | | | | |
|---|---|---|---|---|
| 5,111,290 | A | 5/1992 | Gutierrez | |
| 5,117,122 | A * | 5/1992 | Hogarth et al. | 307/140 |
| 6,200,159 | B1 * | 3/2001 | Chou | 439/535 |
| 6,275,375 | B1 | 8/2001 | Nam | |
| 6,547,589 | B2 * | 4/2003 | Magyar et al. | 439/535 |
| 6,589,073 | B2 * | 7/2003 | Lee | 439/535 |
| 6,637,104 | B1 | 10/2003 | Masuda et al. | |
| 6,642,450 | B1 * | 11/2003 | Hsiao | 174/53 |
| 6,713,678 | B2 | 3/2004 | Masuda et al. | |
| 6,879,961 | B1 | 4/2005 | Pathirana | |
| 2003/0176100 | A1 * | 9/2003 | Yurek et al. | 439/535 |
| 2005/0170690 | A1 * | 8/2005 | Cole | 439/535 |
| 2007/0037442 | A1 * | 2/2007 | Sullivan et al. | 439/535 |

* cited by examiner

*Primary Examiner*—Gary F. Paumen
(74) *Attorney, Agent, or Firm*—Klauber & Jackson LLC

(57) ABSTRACT

The present invention relates to the mounting of electronic display devices with portals for attaching various other electronic devices using cables in a streamlined, versatile fashion. More specifically, the present system relates to an apparatus that provides cable management for electronic devices such as audio speakers, LCD projectors, electronic text boards, televisions, liquid crystal display (LCD) or other flat panel monitors ("display monitors"), and many other electronic devices. Furthermore, the present invention provides a versatile mounting system whereby any of the above electronic devices can be conveniently affixed to a variety of surfaces, such as walls, desks, and even unconventional bases such as store displays or mannequins. Thus, an improved system and method is therefore provided for the mounting of electronic devices, and includes portals for providing power and various signals from other electronic devices that virtually eliminates the unsightly, potentially dangerous presence of dangling cables and cords is provided for in a streamlined, versatile fashion that allows for versatile mounting across numerous vertical and horizontal surfaces, as well as on unconventional surfaces such as store displays, including mannequins.

4 Claims, 4 Drawing Sheets

ELECTRONIC DEVICE MOUNTING APPARATUS

BACKGROUND

Electronic devices such as display monitors and the like are needed in a variety of settings. In doing so, it may be difficult to provide for monitors to be universally deployed against such a wide range of settings. Also, various electronic devices such as computer monitors (including flat panel and cathode ray tube (CRT) displays), televisions, video players and recorders, projectors and the like all require cables to connect these devices to other components in the particular system and/or to provide power. An electronic device may have multiple cables and power cords dangling. This can be at the very least, unsightly and can interfere with usability. At the very worst, dangling cables and cords may be dangerous because they may cause a person to trip and fall over them, or may cause damage to equipment by becoming ensnared.

BRIEF DESCRIPTION

A system for mounting of diverse electronic devices such as electronic display monitors, televisions, speakers, LCD projectors, electronic text boards, etc., across a wide range of surfaces in a streamlined, safe, convenient and aesthetically pleasing manner is disclosed herein. At its broadest aspect, the present invention relates to a system and a method for mounting an electronic device at a rear or bottom surface of the device for managing power and signal connections associated with the electronic device, including a mount apparatus comprises a substantially elongated support member having an upper portion and a lower portion, wherein the upper portion is structured so as to couple to the rear surface of the electronic device through a positionable joining member, with a plurality of power and signal portals integrally provided on the support member for receiving power and cable connections associated with the electronic device, the plurality of power and signal portals having at least one connection selected from the group comprising AC power connections, RCA-type connections, DC power connections, USB ports, optical connections, S-video connections, DVI connections, HDMI connections, component video connections, Cat-5 connections, composite video connections, XLR audio connections, coaxial connections, composite video connections, an integrated power and signals bus contained substantially within the support member, the integrated power and signals bus having respectively configured conductive connections, with each having at least one connection within the plurality of power and signal portals, and an anchor extending from said lower portion of said support member for anchoring said support member about a desired surface. A further embodiment may include a mount apparatus that is adapted for mounting of an electronic device such as an electronic display device such as a flat panel video monitor, the mount having input portals such as AC power connections, RCA-type connections, DC power connections, S-video connections, DVI connections, HDMI connections, component video connections, Cat-5 connections, composite video connections, XLR audio connections, coaxial connections, composite video connections, whereby the electronic display or other electronic device is in conductive communication by said input portals with said mount apparatus through the plurality of power and signal portals of said mount apparatus, an integrated power and signals bundle or bus being provided with conductive communication that extends substantially through lower portion of said support member for connection with power and signal sources external to said mount apparatus. Another embodiment may include providing a substantially elongated support member formed from a rigid material that can bear a given weight of said electronic display or other electronic device proportionate to mounting angle and elongation length, and may include the anchor having a stabilization portion that is selected from the group comprising a substantially flat base or a stabilizing rod, and may be attached to a flat structural surface by the substantially flat base. In yet another embodiment, the mount apparatus may further comprise a store display such as a mannequin, whereby the monitor mount is attached to an upper portion of a mannequin by use of the stabilizing rod. Furthermore, an exemplary store display may be a mannequin configured to display wares and/or services to prospective customers, wherein the mannequin may include articles relating to the wares and/or services offered for sale, and may provide for the conductive communication to extend substantially through lower portion of said support member for connection with power and signal sources external to the mount apparatus by being further configured to communicate with a power supply and a remote and/or local control system through wires hidden within a torso of the display or mannequin, the control system having stored video and audio information pertaining to the wares and/or services.

DETAILED DESCRIPTION

Those of ordinary skill in the art will realize that the following description of the present system is illustrative only, and not in any way limiting. Other embodiments will readily suggest themselves to such skilled persons having the benefit of this disclosure. Similar designations used herein are intended to designate substantially similar matter.

Figure 1:
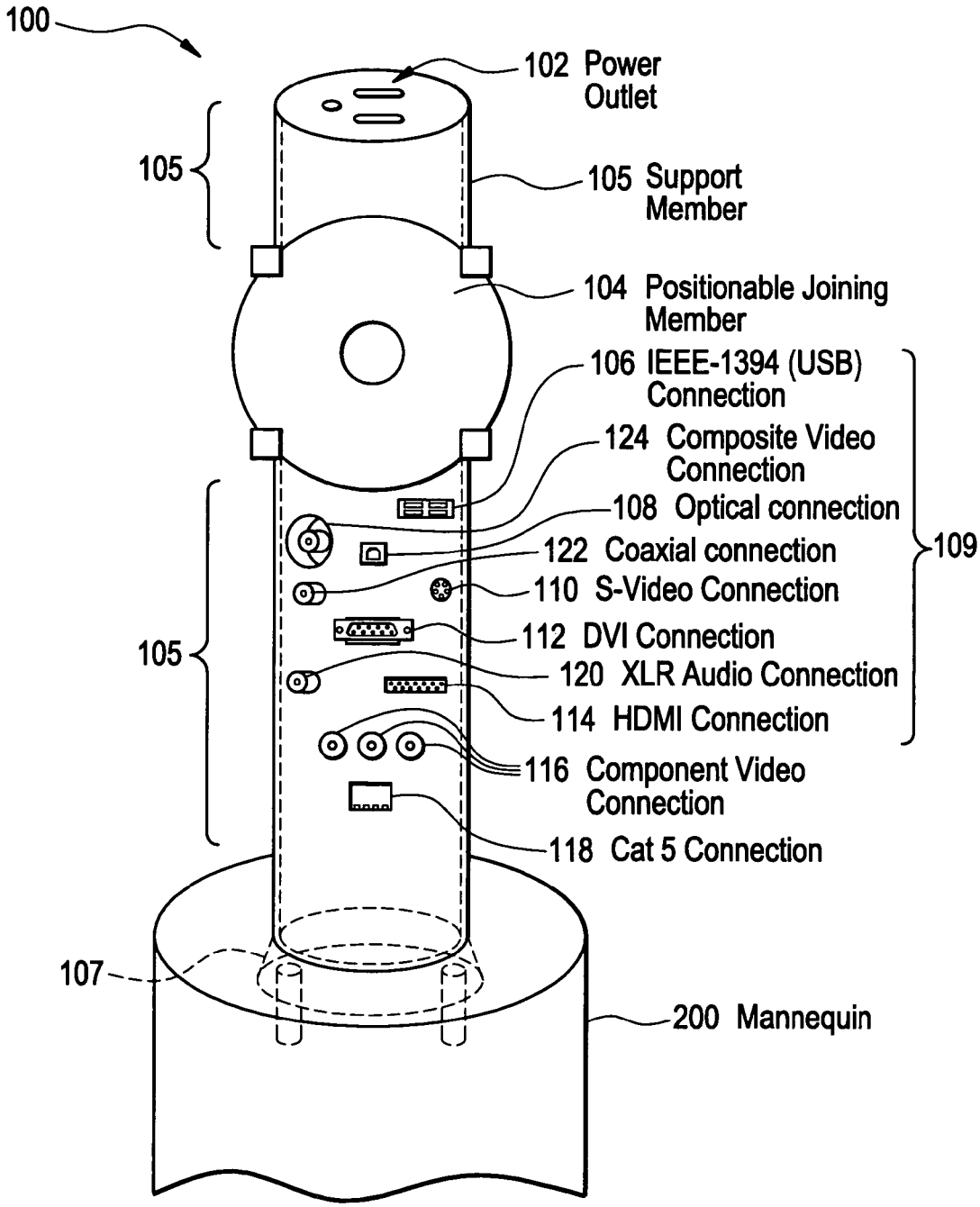
FIG. 1 shows the mount apparatus according to the present system.

FIG. 1 shows the system for mounting an electronic display, including at least the mount apparatus 100 configured for use the teachings of this disclosure. Mount apparatus 100 may comprise a substantially elongated support member 105 having an upper portion and a lower portion, the upper portion being structured for coupling to the rear surface of said electronic device through a positionable joining member 104, and an anchor 107 that may be a substantially flat securing portion, a rod or the like. Disposed on the surface area of support member 105 may include any one or more of the following support member portals 109: power outlet(s) 102, universal serial bus (USB) portals 106, optical connection(s) 108, S-video connection (s) 110, DVI connection(s) 112, HDMI connection(s) 114, component video connection(s) 116, cat 5 connection(s) 118, XLR audio connection(s) 120, coaxial connection(s) 122, composite video connection(s) 124, and other portals as may be needed. Any kind of electronic device, such as electronic display monitors, televisions, speakers, LCD projectors, electronic text boards, etc. may be mounted on the versatile mount contemplated by the present invention. For purposes of mere illustration, one exemplary device, a display monitor ("monitor") 202 (depicted hereafter FIG. 2) is illustrated throughout as an example of how the mount may attach to a given electronic device. In one embodiment, the mount apparatus is designed so as to have a streamlined, centralized capacity for diverse connections through the provision of a plurality of ports 109 on the support member 105 for provision of connections of multiple cables for power and connection to the computer hard drive, speakers, a video player, a video camera, digital video input, power cords, serial port hubs (such as USB ports). Support member portals will provide a streamlined, easily accessible face through the coordinated positioning of the respective portals across the outer surface of the support member 105. The support member may be formed of any flexible or rigid material that is capable of supporting the weight of the given type of display 202, and depending on the angle at which the display is being supported (e.g., a 90 degree support directly off the face of a wall will require a proportionately more rigid materials for construction of the support member 105. Accordingly, the support member 105 may be formed from virtually any material, but will most often be formed from metal or hard plastic and will include a positionable member 105 for joining the display 202 securely with support member 105. Either way, the connectivity from the portals will be situated substantially within (not depicted) the support member 105, or will substantially aligned in bundled groupings along the length of support member 105 so provide for ease of connective installation and so as to avoid the unsightly and potentially damaging exposure of dangling cables and cords from behind the monitor. In an alternative embodiment, the portals may feed into an integrated bus structure that provides for power and signal connectivity within elongated member 105, such as that depicted in the exemplary integrated bus shown in FIG. 4 where one embodiment of the integrated bus of the mount apparatus according to the present system may include the above described support member portals 109 being fixed portals disposed on the surface of elongated member 105 or other suitable surface, and having bundled cable connections 406 that may further be sealed with a plastic covering or other materials, and may also be in varying lengths depending on need. As needed, the bundled cables connections 406 may have mirror ports 402 and or power wiring 404 at a far end so as to provide further power and signal connectivity.

Figure 2:
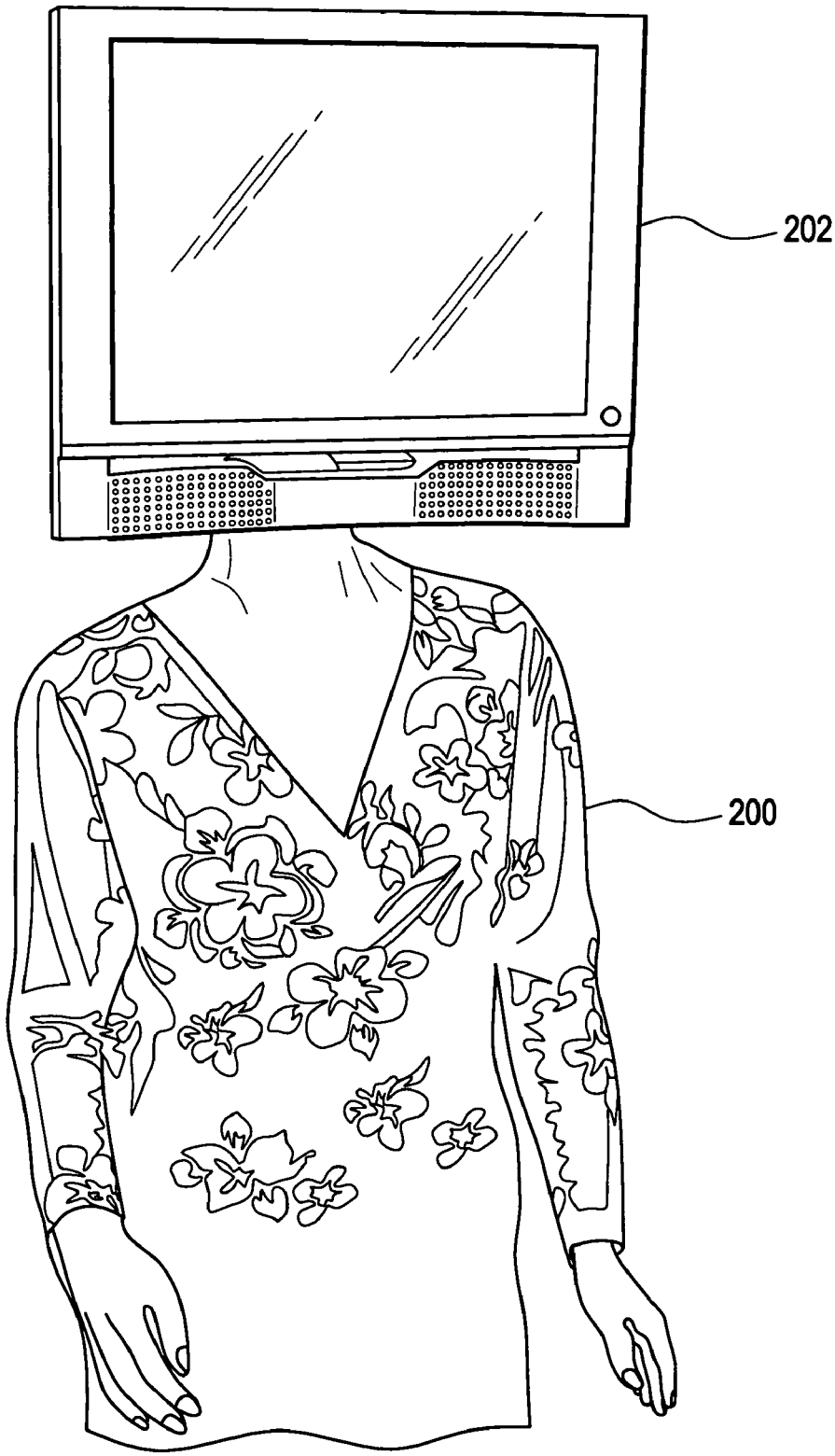
FIG. 2 is a frontal view of one embodiment of the mount apparatus deployed on an exemplary electronic device such as the illustrated flat panel monitor that is mounted on an exemplary unconventional setting, such as a store mannequin.
Figure 3:
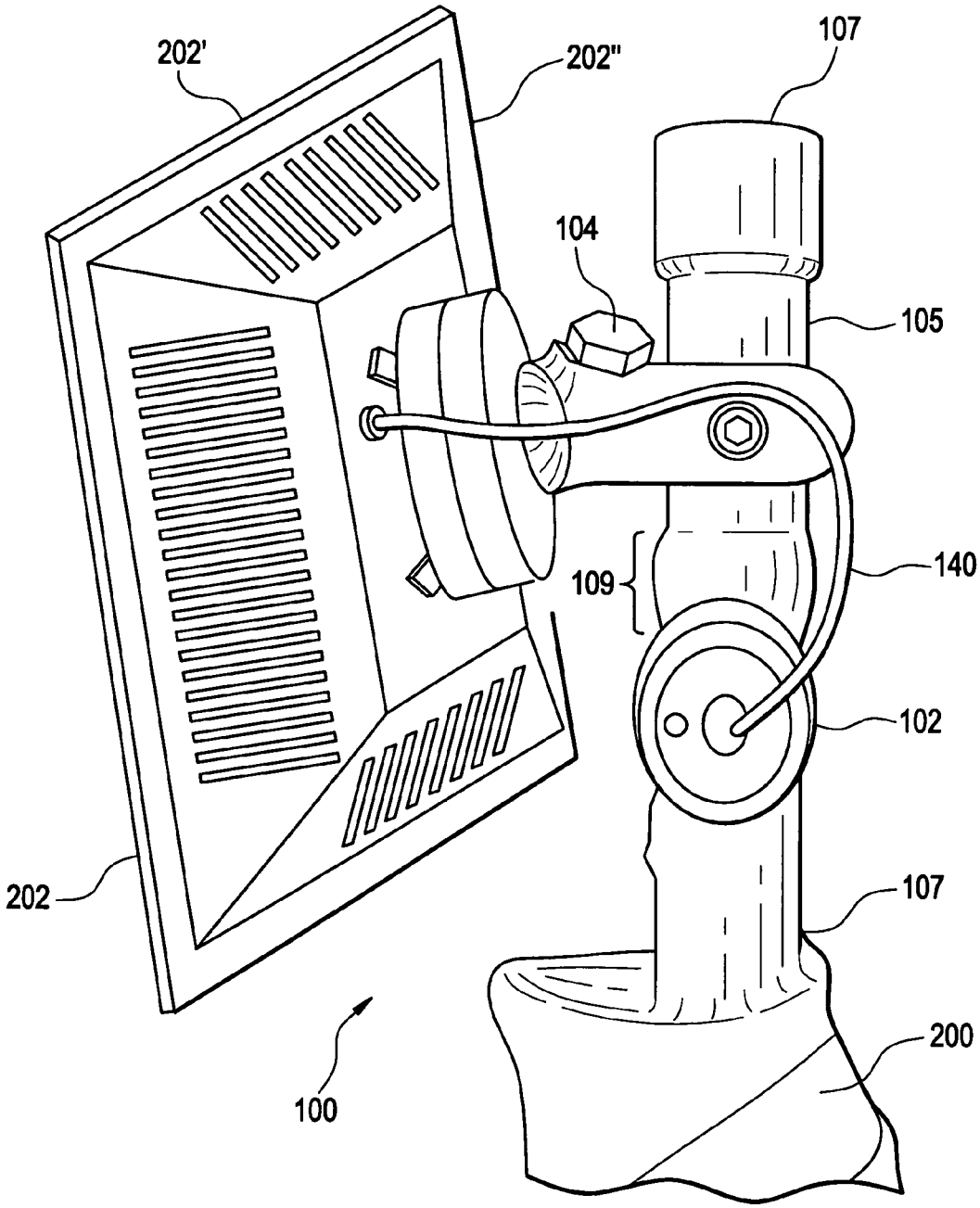
FIG. 3 is an offset rear view of one embodiment of the mount apparatus deployed on an exemplary electronic device such as the flat panel monitor that is mounted on an exemplary unconventional setting, such as a store mannequin.

Accordingly, FIG. 2 shows a frontal view of one embodiment of the mount apparatus deployed on a flat panel monitor and mannequin, though this is but one illustrative example of a disclosed system. The mount apparatus is designed so as to accommodate both a broad range of electronic devices that may be attached to it at one end, and a broad range of surfaces (desks, walls, novelty bases such as mannequins, etc.) to which the mount (and thereby the electronic device) may be affixed at the other end. To this end, FIG. 3 shows a rear view of one embodiment of the mount apparatus deployed on the exemplary flat panel monitor and the novelty base of a mannequin. As will be appreciated by those of ordinary skill in the art having the benefit of this disclosure, the disclosed system may be used on any variety of electronic displays requiring power and signal (e.g. cable) connections to other electronic devices. Thus, FIGS. 1 and 2 are shown as illustrative examples only, and in no way limits the disclosed system. Also shown in FIGS. 1, 2 and 3 is support member 105 coupled to an electronic display, such as exemplary flat panel monitor 202. Support member 105 and display 202 will be discussed in greater detail below. As previously mentioned, the electronic device that may be attached to the mount apparatus may be any kind of electronic devices such as electronic display monitors, televisions, audio speakers, LCD projectors, electronic text boards, etc., but as depicted in the illustrative depiction is electronic display 202, but in any case, the given electronic device will have a substantially bottom or rear surface 202'. Disposed on the exemplary rear surface 202' of the exemplary display 202 are a plurality of input portals 202" for optionally receiving (preferably shortened) cables 140 that may emanate from support member portals 109 of the integrated bus contained within support member 105. In another aspect of the disclosed system, there may only be one input portal for video and a power input.

In one alternate aspect of the disclosed system, the display monitor 202 may be mounted to a wall, desk, or substantially flat surface. In this case, the power and signal portals 105 are disposed in such a way that they are facing in such a way as to be readily accessible when the display 202 is in use. In the present example, support member portals 109 are may be located in different areas in order to accommodate both the particular display 202 being used, as well as to accommodate the particular installation (e.g., whether horizontal desktop, vertical wall, store display (mannequin, etc.), so as to be easily accessed by the user of the electronic device, without compromising aesthetics and/or the danger of dangling cords and cables.

By way of one illustrative embodiment, the inventive mount apparatus, because of its innovative structure, may even be deployed in unconventional settings, such as store displays. One aesthetically appealing, yet useful application might be the novel integration of a monitor with a mannequin for advertising wares and services and for providing information regarding, say clothes in an eye-catching display to lure clothing store customers. The mannequin based display monitor is just one of potentially infinite varieties of innovative store displays that may provide an opportunity for participating stores to attract prospective customers to the marketing apparatus where selected wares and services can be advertised by way of an audio-video feed. The mannequin head may be replaced by a display device which is hard-wired in a streamlined, un-obtrusive way to the remote computer controls. In this manner, adjacent pedestrians and shoppers attracted by the mannequin can easily view display panel to obtain further information concerning certain merchandise and services.

Figure 4:
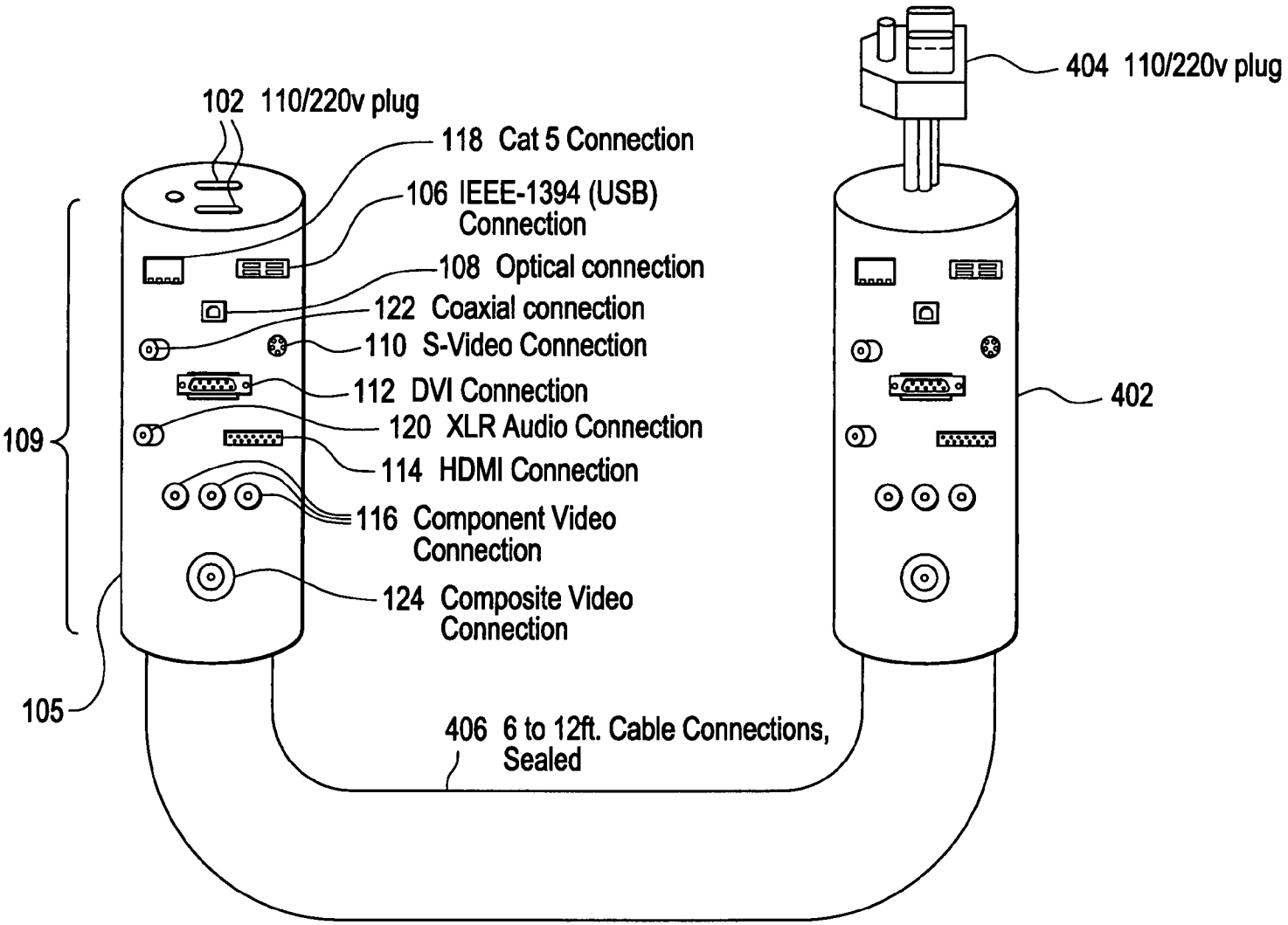
FIG. 4 shows one embodiment of the integrated bus of the mount apparatus according to the present system.

The mannequin 200 itself may be dressed in or wearing articles available for purchase and described in the information available through use of the interactive display panel 202. Optionally, the mannequin 200 may be dressed to promote a service. For example, the display 202 may replace the head of mannequin 200 and may promote services or goods available near the mannequin display site, such as the latest clothing styles or fashions from say, the designer whose clothes the mannequin may be wearing. The display panel 202 may be connected by wiring internally disposed to support member 105, or through an internal bus as also shown in FIG. 4, within the support member 105 of the mounting apparatus, and thereafter, within or concealed behind the mannequin 200 or other store display to a remote control system (not depicted). Among other things, the control system may be either local and/or remote and may be designed according to audio-video control systems as are currently known in the art, such as a master audio visual system or a DVD player, and may provide the relevant video and audio feed to the prospective customer via the display 202 and any attached speakers disposed therewith. Software as known in the art of remote video control and display systems may be further provided within the local or remote control system, thereby allowing the merchant to modify the software as desired to address the customer needs. To provide upright stability to the mannequin 200, it may be secured to the support floor by fasteners of choice. Alternatively, the mannequin 200 may be juxtaposed against a wall or a support column or the like and similarly secured to provide the needed stability.

Depending on the surface upon which the mount apparatus 100 is to be employed, there is provided for a variety of anchors that are attached to the lower portion of support member 105. Anchor 107 will typically extend from the lower portion of support member 105 for anchoring the support member on a desired surface. To this end, the anchor 107 has a stabilization portion that may be almost fashioned according to almost any need, but will most often be a substantially flat base or a stabilizing rod. Where the mount apparatus 100 is to be attached or situated on a flat structural surface (such as a desk or a wall), the anchor 107 may be a substantially flat base with or without brackets, screw, etc. for securing thereon the desired surface. Where the mount apparatus 100 is to be attached or situated to a mannequin, the anchor may be a stabilizing rod situated within, say, the torso of the mannequin 200, and extends from the lower portion of support member 105, through, say, the neck of the mannequin down into the torso for stability. Alternatively, the anchor may be a securing means such as brackets, screws, blots, etc. that is capable of securing the mount apparatus 100 to the mannequin. Regardless of the exact surface upon which the mount apparatus is secured, the overall structure must be able to support the display 202 weight, and must account for angle of disposition of display along support member 105 (e.g. whether extended off a purely vertical axis, etc.) and environmental stresses, such as potential for mishandling, vibrations, tampering, theft etc.

Either way, the signals (as well as the power supply cord) from the control system to be used with the display 202 will come through the cables that are disposed within or substantially along the body of mannequin 200, through the wiring or bus within support member 105, out through support member portals 109, through short, tailored, intermediate cables (not depicted) into the electrical and signal portals (not depicted) of the display 202, for supplying of power and audio video content to the display 202. Because the vast majority of the entire wiring/cabling of the power and signals needs of the display are internally disposed within (or at least substantially aligned outside) the support member 105 and the mannequin 200, the aesthetic and safety needs of the store display are provided for accordingly.

While embodiments and applications of this system have been shown and described, it would be apparent to those skilled in the art that many more modifications than mentioned above are possible without departing from the inventive concepts herein. The system, therefore, is not to be restricted except in the spirit of the appended claims.

What is claimed is:

1. A mount apparatus for mounting an electronic device at a rear surface and for managing power and signal connections associated with said electronic device, said mount apparatus comprising:

a substantially elongated support member having an upper portion and a lower portion, said upper portion being structured for coupling to said rear surface of said electronic device through a positionable joining member, and wherein said substantially elongated support member is formed from a rigid material that can bear a given weight of said electronic device proportionate to mounting angle and elongation length;

a plurality of power and signal portals integrally provided on said support member for receiving power and cable connections associated with at least said electronic device, said plurality of power and signal portals having at least one connection selected from the group comprising AC power connections, RCA-type connections, DC power connections, USB ports, optical connections, S-video connections, DVI connections, HDMI connections, component video connections, Cat-5 connections, composite video connections, XLR audio connections, coaxial connections, composite video connections;

an integrated power and signals bus contained substantially within said support member, said integrated power and signals bus having respectively configured conductive connections with each at least one connection within said plurality of power and signal portals;

said integrated power and signals bus provided with conductive communication that extends substantially through lower portion of said support member for connection with power and signal sources external to said mount apparatus;

an anchor extending from said lower portion of said support member for anchoring said support member about a desired surface, said anchor having a stabilization portion that is selected from the group comprising a substantially flat base or a stabilizing rod; and an electronic display device mounted to said apparatus, said electronic display comprising a flat panel video monitor having at least one input portals selected from the group comprising AC power connections, DC power connections, S-video connections, DVI connections, HDMI connections, component video connections, Cat-5 connections, composite video connections, XLR audio connections, coaxial connections, composite video connections, said electronic display device being in conductive communication by said input portals with said mount apparatus through said plurality of power and signal portals of said mount apparatus.

2. The mount apparatus of claim 1, wherein said mount apparatus is attached to a flat structural surface by said substantially flat base.

3. The mount apparatus of claim 1, further comprising a mannequin, wherein said monitor mount is attached to an upper portion of a mannequin with said stabilizing rod.

4. The mount apparatus of claim 3, where said mannequin is configured to display wares and/or services to prospective customers, and said mannequin includes articles relating to the wares and/or services offered for sale, said conductive communication that extends substantially through lower portion of said support member for connection with power and signal sources external to said mount apparatus being further configured to communicate with a power supply and a remote control system through wires hidden within a torso of said mannequin, said remote control system having stored video and audio information pertaining to the wares and/or services for output to said mount apparatus and display on said electronic display device.

* * * * *